US007650873B2

(12) United States Patent
Hofbauer et al.

(10) Patent No.: US 7,650,873 B2
(45) Date of Patent: Jan. 26, 2010

(54) SPARK IGNITION AND FUEL INJECTOR SYSTEM FOR AN INTERNAL COMBUSTION ENGINE

(75) Inventors: Peter Hofbauer, West Bloomfield, MI (US); Bengt Ebbeson, Punta Gorda, FL (US)

(73) Assignee: Advanced Propulsion Technologies, Inc., Goleta, CA (US)

( * ) Notice: Subject to any disclaimer, the term of this patent is extended or adjusted under 35 U.S.C. 154(b) by 232 days.

(21) Appl. No.: 11/825,156

(22) Filed: Jul. 3, 2007

(65) Prior Publication Data

US 2008/0006238 A1 Jan. 10, 2008

Related U.S. Application Data

(60) Provisional application No. 60/818,628, filed on Jul. 5, 2006.

(51) Int. Cl.
*F02M 57/06* (2006.01)
*F02P 13/00* (2006.01)

(52) U.S. Cl. ..... 123/297; 123/151

(58) Field of Classification Search ..... 123/297, 123/151, 152, 169 EL, 169 E, 169 PA
See application file for complete search history.

(56) References Cited

U.S. PATENT DOCUMENTS 4,090,479 A * 5/1978 Kaye ..... 123/306
RE29,978 E * 5/1979 Leshner et al.
4,305,349 A * 12/1981 Zimmerly ..... 123/51 BB
4,343,272 A * 8/1982 Buck ..... 123/297
4,419,969 A * 12/1983 Bundrick, Jr. ..... 123/48 R
5,083,530 A * 1/1992 Rassey ..... 123/51 R
5,497,744 A 3/1996 Nagaosa et al.
6,748,918 B2 6/2004 Rieger et al.
6,755,175 B1 6/2004 McKay et al.
6,883,490 B2 * 4/2005 Jayne ..... 123/260
6,925,983 B2 8/2005 Herden et al.
6,955,154 B1 10/2005 Douglas
2005/0224043 A1 * 10/2005 Vogel et al. ..... 123/297
2007/0169727 A1 * 7/2007 Reisser ..... 123/45 R
2008/0072871 A1 * 3/2008 Vogel et al. ..... 123/297

* cited by examiner

*Primary Examiner*—John T Kwon
(74) *Attorney, Agent, or Firm*—Paul K. Godwin P.C.

(57) ABSTRACT

An improved spark ignition system for an internal combustion engine that includes a pair of electrodes disposed to extend from opposite sides and into a combustion chamber to form a spark gap between them that is central to the combustion chamber. Each electrode is integral with a conductive fuel delivery tube that contains a capillary passage and fuel outlet ports adjacent the electrode. The heat from combustion conducted into the electrodes and fuel delivery tubes is used to vaporize the fuel within the capillary passages before it exits the outlet ports as an atomized fog into the combustion chamber adjacent the spark gap. The vaporization of the fuel flowing in the capillary passages absorbs energy from the electrodes and thus performs a cooling effect on the electrodes. The spacing of the electrodes from opposite sides of the cylinder also allows a design that can utilize and increased spark gap to produce a larger spark across the gap.

20 Claims, 4 Drawing Sheets

SPARK IGNITION AND FUEL INJECTOR SYSTEM FOR AN INTERNAL COMBUSTION ENGINE

RELATED APPLICATION

This application claims benefit of U.S. provisional application Ser. No. 60/818,628 filed Jul. 5, 2006.

TECHNICAL FIELD

This invention is related to the field of internal combustion engines and more specifically to a spark ignition and fuel injection system utilized therein.

BACKGROUND

Conventional internal combustion engines are configured with spark plugs which contain two electrodes. A powered electrode is mounted within an insulator sleeve to have one end located within the cylinder. A ground electrode is configured to be opposed across an air gap with respect to the powered electrode. Such spark plugs are unitary in nature, since they contain both electrodes in a single unit.

In some cases, spark plugs have been combined with fuel injectors to inject fuel through a nozzle into air gap portion of the spark plug. Such combinations also are unitary in nature since they contain the spark plug elements and fuel injector elements in a single unit.

In each case, the location within the combustion chamber of the spark generated across the arc gap is limited by the relatively short length of the spark plug body extending into the combustion camber. In addition, because of the split nature of how a conventional ignition coil is used, the ignition voltage and current capacity dictates that the arc gap be relatively small. This, in turn, allows for a correspondingly small spark.

In some two-cycle engines, such as the Internal Combustion Engine With A Single Crankshaft And Having Opposing Cylinders And Opposing Pistons in each cylinder ("OPOC engine") described in U.S. Pat. No. 6,170,443 and incorporated herein by reference, the combustion chamber is formed by opposing pistons which converge towards each other during the compression stroke. In such an engine that has no cylinder head, the mounting of a conventional spark plug is limited to the side of a cylinder. Depending on the diameter of the cylinder, the spark gap is usually located to one side and therefore off-center to the formed combustion chamber. When an off-center spark location is used, accommodations have to be made to the engine. For instance, special piston face configurations are required in order to approach an even distribution of combustion forces across each piston face.

SUMMARY OF THE INVENTION

The present invention utilizes a pair of fuel injector tube and spark electrode combinations that separately extend through opposing sides of a cylinder. Each injector tube delivers atomized air/fuel mixture adjacent to a spark gap defined between the electrodes and each electrode is integral with the fuel injector tubes. The invention provides three key improvements over prior art ignition systems utilized in internal combustion engines: 1) a larger spark is capable of being produced; 2) the spark is capable of being produced in the diametrical center of the cylinder; and 3) more complete burn is achieved. All these improvements are significant in helping to improve the efficiencies of the engine. Since the electrodes are integral with the fuel injectors, there is a cooling effect produced by the fuel passing through the body of the electrodes. This helps to prevent excessive heat buildup in the electrodes and resultant premature ignition.

The present invention includes a pair of electrode elements that are mounted on a cylinder in opposition, either in a coaxial alignment or at an angle, to each other, in such a way as to provide a spark gap that is generally central to the combustion chamber or at any desired distance from the cylinder wall.

In the disclosed embodiment, each electrode is connected to the opposite end of an ignition coil to take advantage of the full voltage potential created by the coil. Preferably, neither electrode is grounded. As such, this allows for a spark gap that can be approximately twice what it could be when compared to a conventional spark plug which has a grounded electrode. A larger spark makes it possible to improve ignition and resulting combustion within the cylinder.

Each of the electrodes is configured to include a fuel injector delivery tube and nozzle that allows atomized fuel vapor to be sprayed adjacent to the spark gap for ignition and combustion.

The present invention provides several key improvements to the ignition system of an internal combustion engine. A larger spark is produced because of the increased spacing and non-grounded relationship of the opposing electrodes, as well as the higher voltage potential available to be applied between the electrodes. The spark gap is located more central to the combustion chamber formed in the cylinder to improve ignition and combustion. Heat produced by combustion within the cylinder causes the fuel within the fuel delivery tubes to be vaporized and emitted as a fog or cloud of atomized fuel vapor. The fuel vapor is injected adjacent to the spark gap to improve combustion efficiency. The heat absorbed by the fuel passing through the fuel delivery tubes causes the electrodes to be cooled sufficiently to prevent heat buildup in the electrodes which may otherwise cause premature auto ignition.

DETAILED DESCRIPTION OF EMBODIMENTS OF THE INVENTION

Figure 1:
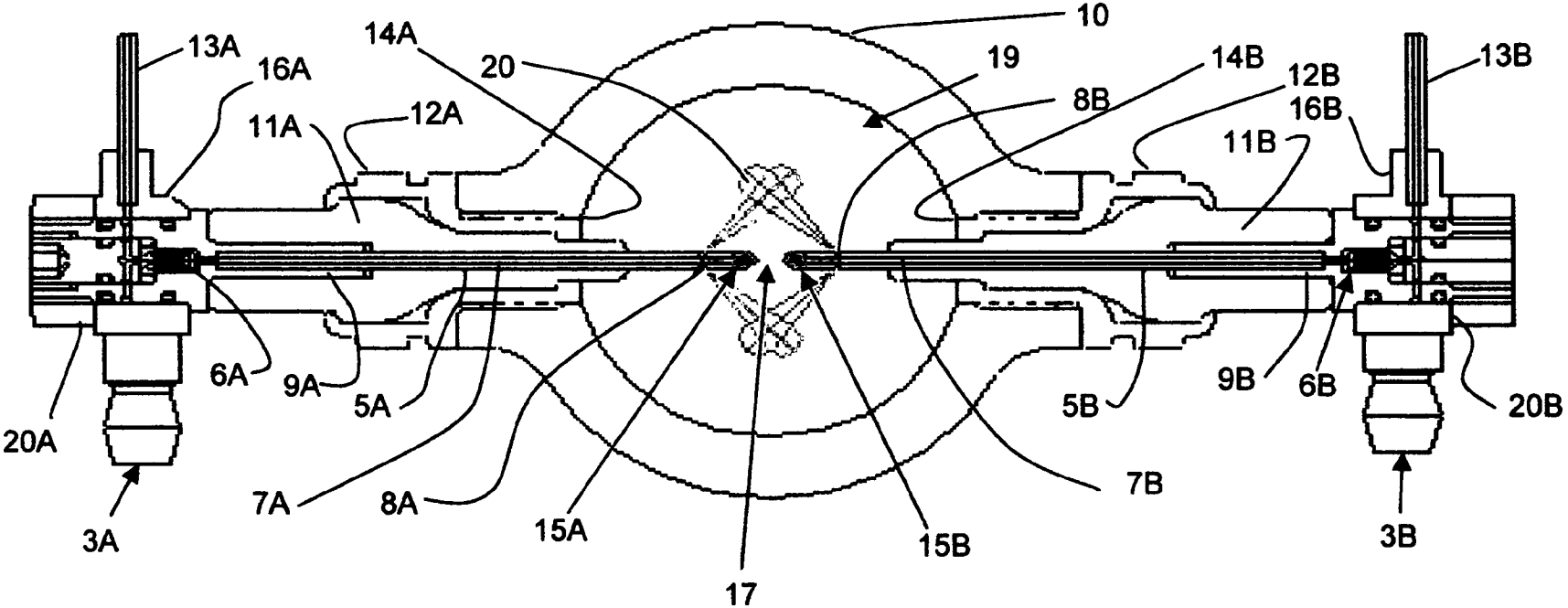
FIG. 1 is a cross-sectional drawing of a preferred embodiment of the spark ignition and fuel injection combination of the present invention in a combustion chamber.

In FIG. 1, an embodiment of the present invention is shown mounted in a cylinder 10 of an internal combustion engine. In a cross-section of the combustion chamber portion 19 of the cylinder 10, opposing electrode tips 15A and 15B are shown mounted on each side to extend towards each other. The electrodes 15A and 15B are separated from each other by a predetermined distance that defines an air/spark gap 17. Each electrode is correspondingly integrated with fuel tubes 5A and 5B, respectively. The fuel tubes are electrically conductive and contain capillary passages 7A and 7B which allow fuel to flow therein. Injector nozzle ports 8A and 8B are formed in the fuel tubes to allow atomized fuel vapor to be injected into the combustion chamber adjacent to gap 17.

Electrode tip 15A is mounted at the end of an electrically conductive fuel tube 5A that extends from a tube casing 11A. Tube casing 11A is formed of a non-conducting insulator material, such as a high temperature ceramic, and is mounted in and supported by a threaded nut housing 12A. Threaded nut housing 12A is threadedly connected to fuel port 14A of cylinder 10. The outer end of fuel tube 5A is connected to a check valve 6A that is normally open to allow passage of injected fuel to enter capillary passage 7A. Check valve 6A, in this embodiment, is embedded in end piece 20A and is in line with an electrically non-conductive fuel supply line 13A. End piece 20A is connected to tube casing 11A and provides support for an electrical spark plug terminal 3A as well as a fuel line connector 16A. Check valve 6A is located between fuel line connector 16A of end piece 20A and the outer end of fuel tube 5A. It functions to allow passage of injected fuel into the cylinder 10, and closes in reaction to reverse pressures which develop during combustion with the cylinder 10 to protect the associated injector meter valve and fuel line elements.

Electrode tip 15B and its associated elements correspond to those described in the immediately preceding paragraph, but are designated with a "B" subscript.

Electrode tips 15A and 15B are connected to an ignition coil 100 (schematically represented in FIG. 4) through electrically conductive fuel tubes 5A and 5B respectively and conductors at electrical spark plug terminals 3A and 3B respectively. Fuel reaches fuel tubes 5A and 5B via fuel lines 13A and 3B through check valves 6A and 6B. The fuel enters fuel tubes 5A and 5B, which are preferably formed of either stainless steel or nickel, before being atomized and sprayed into the combustion chamber 19 through injector nozzle ports 8A and 8B. Fuel tubes 5A and 5B are electrically insulated from engine ground by use of an insulating material for the bonding agents 9A and 9B, insulated tube casings 11A and 11B and non-conductive high pressure fuel lines 13A and 13B carrying fuel from the meter valve 106 (schematically represented in FIG. 4).

In operation, the atomized fuel vapor is spray injected into combustion chamber 19 starting at a pre-selected time during the compression stroke and prior to the pistons reaching the top dead center ("TDC") positions of their respective stroke cycles. The cloud of fuel vapor 20 surrounds gap 17 and generally fills combustion chamber 19. When a spark is generated across gap 17 between electrodes 15A and 15B the air/fuel mixture in the chamber becomes fully ignited and combustion commences. As can be seen in FIG. 1, the gap 17 can be located in the very center of cylinder 10 and combustion chamber 19 or it can be located to be off-center, if such a design is more practical. The position of gap 17 and its gap distance between electrodes 15A and 15B is determined by the distance of the electrodes from the cylinder wall. Although shown here in a co-axially aligned configuration, it is possible for one to use the same principles described here to angle the fuel tubes with respect to each other (non-axially aligned) and still maintain an effective gap and fuel injection cloud at or near the center of the combustion chamber.

Figure 2:
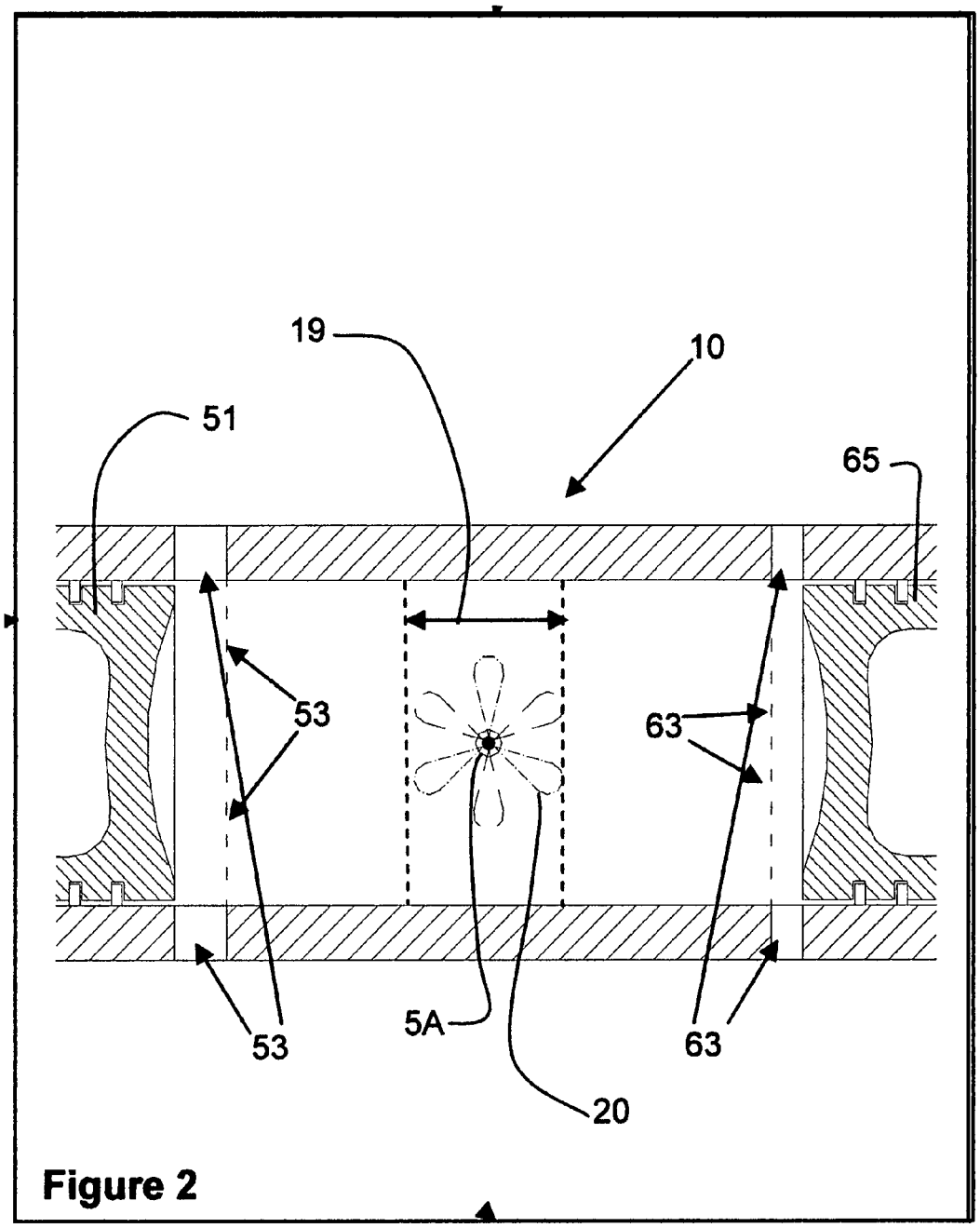
FIG. 2 is a cross-sectional drawing of a portion of a cylinder and pistons which form the combustion chamber of an OPOC engine in which the present invention, as exemplified in FIG. 1, is installed.

FIG. 2 is a cross-sectional plan view of a cylinder 10 and two opposing pistons 51 and 65 in an OPOC engine such as that referenced above. In FIG. 2, piston 51 is the exhaust piston which moves from left to right in cylinder 10 during the compression stroke. Piston 65 is the intake piston which moves from right to left in cylinder 10 during the compression stroke. This diagram shows pistons 51 and 65 at bottom dead center ("BDC"). This means that both pistons are as far away from the center of the cylinder they can reach and will subsequently proceed inward toward each other until they reach their TDC positions to define combustion chamber space 19. A plurality of exhaust port openings 53 are shown to be disposed around cylinder 10 through which combustion gases are removed during the later part of the expansion stroke and the early part of the compression stroke after reaching BDC. A plurality of intake ports 63 are shown to be disposed around cylinder 59 through which air is forced into the combustion chamber prior to compression to mix with the fuel vapor and burn when ignited.

In FIG. 2, a single electrode tip 5A, of the pair of electrodes represented in FIG. 1 is shown to be located at the center of cylinder 10 and at the location of the combustion chamber 19 which is defined by the opposing pistons 51 and 65 reaching TDC of their respective strokes.

Figure 3:
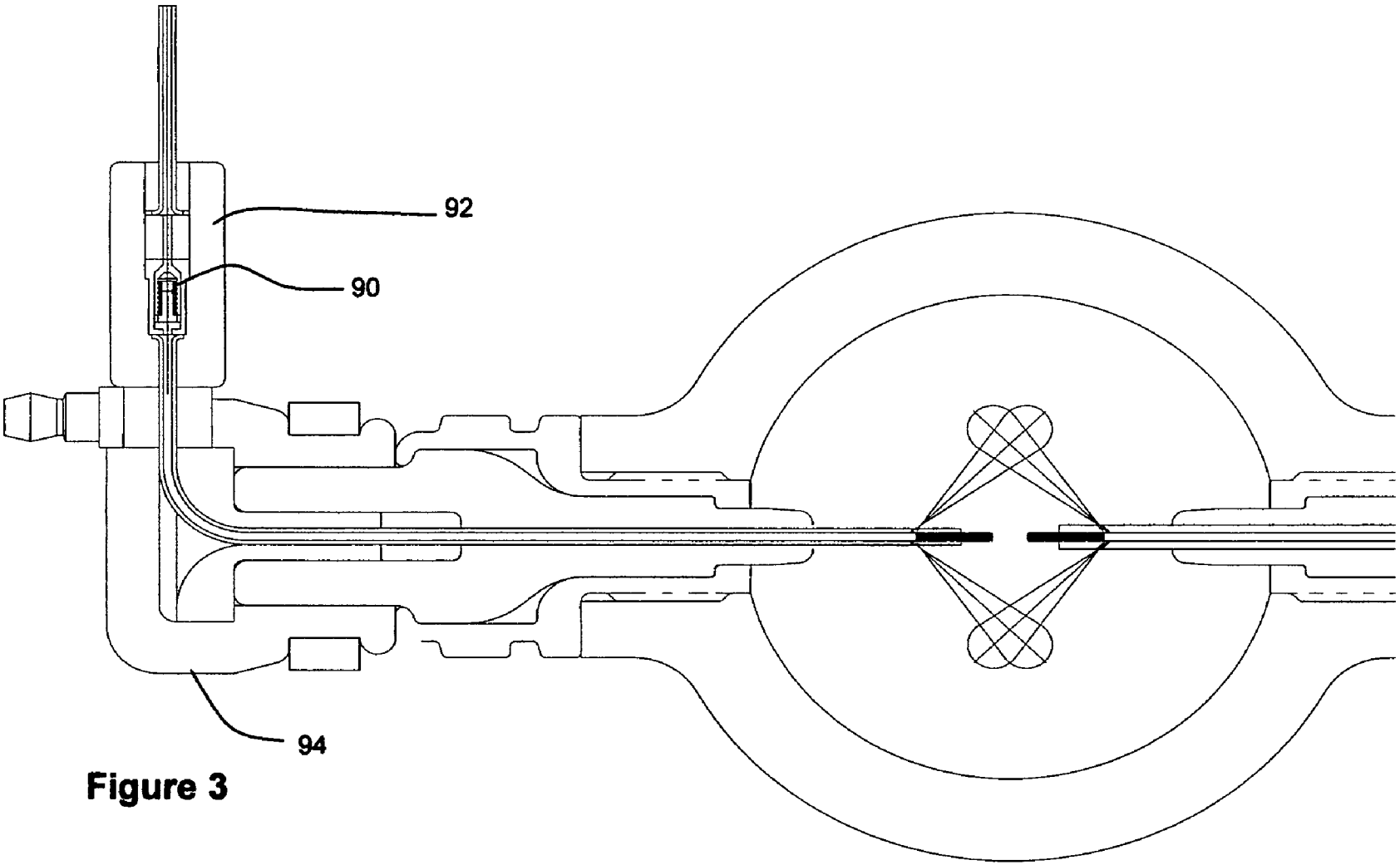
FIG. 3 is a cross-sectional drawing of a spark ignition and fuel injection combination in the combustion chamber shown in FIG. 1, showing a different position for a check valve.

FIG. 3 is a cross sectional diagram of another embodiment of a fuel injector tube and spark electrode combination installed in a combustion chamber similar to that shown in FIGS. 1 and 2. However, in the FIG. 3 embodiment, a check valve 90 is shown as positioned within a fuel line connector 92 external to the end piece 94. This allows easier fabrication and disassembly of the elements. The remainder of the diagram is a repeat of the prior embodiment.

Figure 4:
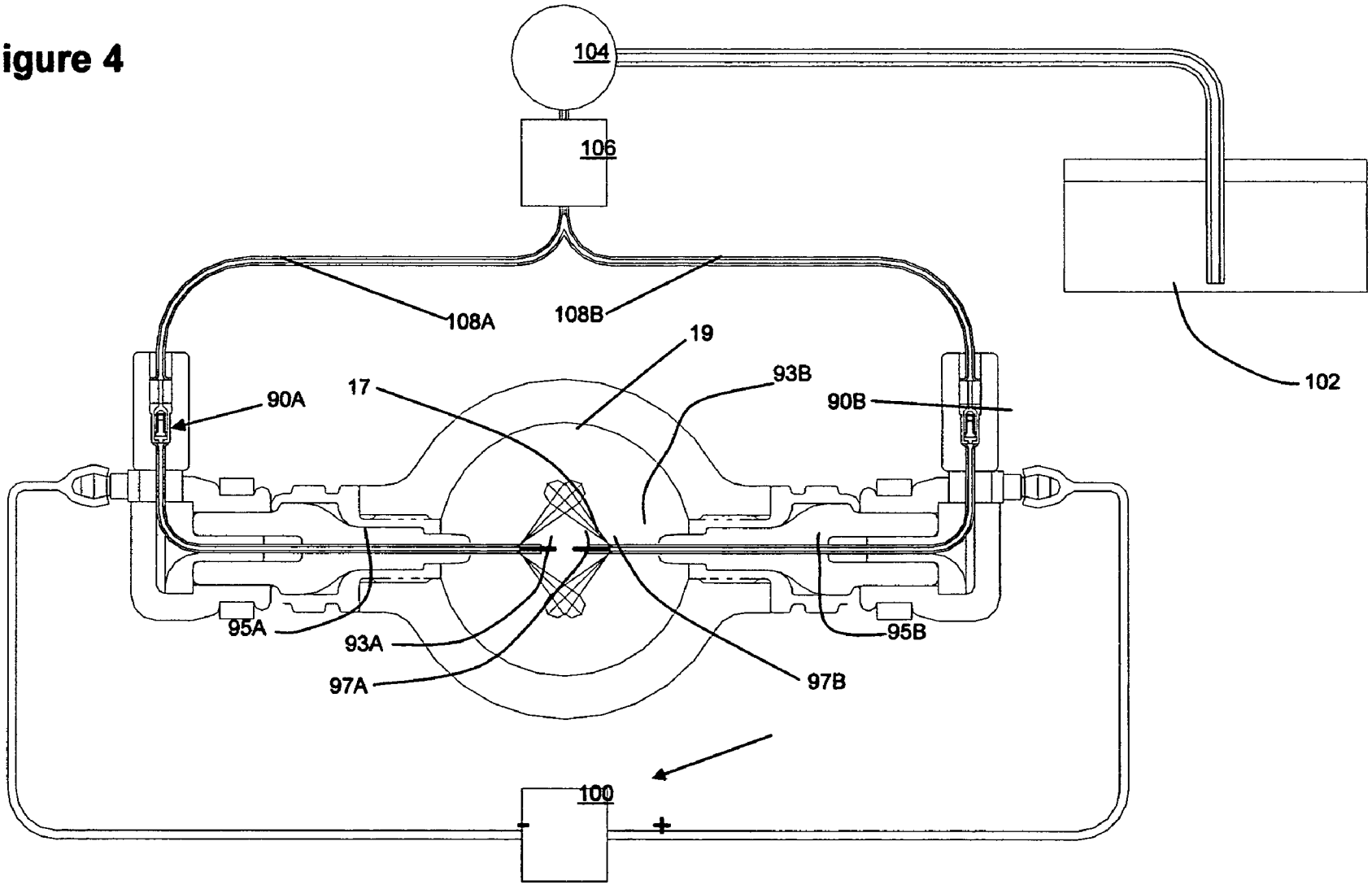
FIG. 4 is a schematic overview of the spark ignition and fuel injection system of the present invention.

FIG. 4 is a schematic overview of the second embodiment of the fuel injector tube and spark electrode combination of the present invention. Ignition coil 100 provides positive and negative (ungrounded) electrical potential directly to opposing electrodes in the same cylinder. Since neither electrode is at ground potential, the electrical potential being applied across the spark gap is twice that applied to a conventional spark plug that sparks to ground. This allows for the gap to be much larger than is in a conventional spark plug and also a greater spark to be generated. In addition, the present invention creates an extremely long path to ground from each electrode tip and therefore eliminates the potential for current leakage within the combustion chamber.

A fuel tank 102 provides a fuel supply to the engine. Fuel pump 104 provides fuel under pressure to the fuel injectors via a fuel meter valve 106. Fuel meter valve 106 is controlled to determine the injection period during the compression stroke and the amount of fuel to be sent to the cylinder. Fuel lines 108A and 108B deliver the fuel from meter valve 106 to check valves 90A and 90B. As mentioned earlier, fuel lines 108 are electrically insulated to isolate the electrical potential applied to the fuel tubes of the electrodes from engine ground. Check valves 90A and 90B are used to prevent the high pressure resulting from ignition in the combustion chamber from reaching the fuel lines 108A and 108B and meter valve 106.

While the present invention is described above as being applicable for several types of internal combustion engines, it is exemplified as suitable for use with engines that burn heavy fuel such as Diesel, JP8, or JP5.

By using a longer spark in the center of the combustion chamber it is possible to ignite heavier fuels. A more optimal burn can also be achieved since the ignition occurs in the center of the combustion chamber rather than off-center or at one side.

In operation, fuel pump 104 pumps fuel through meter valve 106. Meter valve 106 functions to measure and pass the correct amount of fuel at the correct time to be injected. Fuel passes through the fuel lines 108A and 108B (13A & 13B in FIG. 1). The fuel lines are constructed of electrically insulated material or in the alternative, an intermediary assembly needs to be provided that is an electrical insulator to electrically isolate the electrodes and conductors connected to the electrical coil from any grounded components including the cylinder, fuel pump and meter valve. Fuel then passes through check valves 90A and 90B (6A and 6B in FIG. 1) that are normally open to allow the fuel to pass through prior to combustion. As mentioned earlier, the check valves become closed by combustion pressure feedback from the combustion chamber to prevent such pressure from damaging either the fuel lines or the meter valve. The fuel passes through stainless steel or nickel fuel tubes 95A and 95B (5A and 5B in FIG. 1). The ends of the tubes contain electrodes 197A and 97B (5A and 15B in FIG. 1) that are cooled by the fuel passing through them. The fuel is sprayed out of injector nozzle ports 93A and 93B (8A and 8B in FIG. 1) of each tube into combustion chamber 19. This fuel spray is atomized and forms a homogeneous mixture of fuel and air that is ignited by a spark generated between the electrodes when the pistons 51 and 65 shown in FIG. 2 are near but just after their TDC positions.

By virtue of the voltage difference of a positive to negative voltage ignition system being twice that of a charge to ground system, the spark gap of the present invention can be twice what it would be in a charge to ground system. Since the voltage potential existing on either electrode with respect to ground is not increased from what it would be in a conventional charge to ground spark ignition system there is no need to increase the distance from the charged electrode to the cylinder wall or other unwanted potential grounds from what they would be in such a conventional system. This is because the voltage potential of the charge on a charged electrode is the same as it would be in a charge to ground system. It is the presence of two opposite charges in the same cylinder that allows for a larger spark gap between the electrodes to be bridged.

From the foregoing, it can be seen that there has been brought to the art a new and improved system and method for providing a fuel and ignition spark to the combustion chamber of an internal combustion engine. It is to be understood that the preceding description of the embodiments is merely illustrative of some of the many specific embodiments that represent applications of the principles of the present invention. Clearly, numerous other arrangements would be evident to those skilled in the art without departing from the scope of the invention as defined by the following claims.

We claim:

1. A system for producing a spark in a combustion chamber in a cylinder of an internal combustion engine comprising:

a pair of electrodes extending into the combustion chamber portion of a cylinder;

said electrodes having tips opposing each other across a spark gap of a predetermined distance;

said electrodes each being supported by and integral with a separate fuel delivery tube of electrically conductive material and each fuel delivery tube having a capillary tubular passage to allow the flow of fuel therethrough;

said electrodes being located at the ends of said tubes and said tubes having a plurality of ports in communication with said capillaries and adjacent said electrodes for allowing the injection of fuel into said combustion chamber adjacent said spark gap.

2. A system as in claim 1, wherein said electrodes extend into the combustion chamber portion of a cylinder from opposite sides of said cylinder.

3. A system as in claim 2, wherein said electrodes extend into the combustion chamber portion of a cylinder from opposite sides of said cylinder and are coaxial with each other.

4. A system as in claim 1, wherein said electrodes each extend into the combustion chamber portion of a cylinder along a radial towards the center of said chamber at an angle to each other.

5. A system as in claim 1, wherein said electrodes and said fuel delivery tubes are electrically isolated from the common ground potential of said engine.

6. A system as in claim 1, wherein said electrodes are cooled by the flow of fuel through said capillaries and said ports.

7. A system as in claim 1, wherein said electrically conductive fuel delivery tube is formed of a material from the group including nickel and stainless steel.

8. A system as in claim 1, further including a source of pressurized fuel, a controlled injector metering valve, and a check valve associated with each capillary tube, wherein each said check valve is located between said metering valve and said associated capillary tube to prevent combustion pressures created in said combustion chamber from adversely affecting said metering valve.

9. A fuel injector tube and spark electrode combination including a threaded connector housing for connecting said combination to a correspondingly threaded port on the cylinder of an internal combustion engine; an electrically conductive capillary tube extending from said housing, a single electrode tip carried at the end of said capillary tube; an electrical connector on said housing being electrically connected to said capillary tube and said electrode tip; a fuel line connection on said housing being in communication with said capillary tube to allow fuel provided from a pressurized source to flow into said capillary tube; said capillary tube containing at least one opening adjacent said electrode tip to allow said fuel to exit said capillary tube, wherein a plurality of said combinations are employed in an internal combustion engine in opposition to provide an air gap between opposing single electrode tips and applying an electrical potential to each electrical connector at a predetermined time in the cycle of said engine sufficient to generate an arc across said air gap.

10. The combination of claim 9, wherein each said capillary tube contains a plurality of openings immediately adjacent to said single electrode tip.

11. The combination of claim 9, wherein each said capillary tube, said electrode tip, said electrical connector, and said fuel line connection are electrically isolated from said connector housing.

12. The combination of claim 9, wherein a pair of said combinations is employed in the cylinders of an opposing piston opposing cylinder internal combustion engine and each electrode is positioned to define said gap near the center of the cylinder in a defined combustion chamber.

13. The combination of claim 12, wherein the fuel exiting said capillary tube openings adjacent each said electrode tip is atomized and generates an air/fuel cloud mixture that surrounds said gap.

14. The combination of claim 13, wherein said electrical potential is isolated from ground that is in common with the cylinders of said engine.

15. The combination of claim 12, wherein each of said electrodes extend into the combustion chamber portion of a cylinder from opposite sides of said cylinder.

16. The combination of claim 12, wherein each of said electrodes extend into the combustion chamber portion of a cylinder from opposite sides of said cylinder and are coaxial with each other.

17. The combination of claim 12, wherein each of said electrodes extend into the combustion chamber portion of a cylinder along a radial towards the center of said chamber at an angle to each other.

18. The combination of claim 12, wherein said electrodes are cooled by the flow of fuel through said capillaries and said ports.

19. The combination of claim 12, further including a source of pressurized fuel, a controlled injector metering valve, and a check valve associated with each capillary tube, wherein each said check valve is located between said metering valve and said associated capillary tube to prevent combustion pressures created in said combustion chamber from adversely affecting said metering valve.

20. A spark gap ignition system for an internal combustion engine comprising:

a first electrode mounted on the cylinder of said engine and having a single tip that extends into the combustion chamber of said cylinder;

a second electrode mounted on said cylinder of said engine and having a single tip that extends into said combustion chamber of said cylinder;

said tips of said first and second electrodes are mounted on said cylinder in opposition to each other to provide spark gap therebetween of a predetermined distance;

each electrode contains a fuel delivery tube extending along its length from a fuel supply outside said cylinder to a fuel injection opening in said tip;

said tips of said first and second electrodes supporting said electrical discharge across said gap and the injection of fuel through said openings and into said spark gap.

* * * * *